US009885488B2

(12) United States Patent
Shang et al.

(10) Patent No.: US 9,885,488 B2
(45) Date of Patent: Feb. 6, 2018

(54) INDOOR UNIT OF AIR CONDITIONER

(75) Inventors: Bin Shang, Zhuhai (CN); Tangtang Gu, Zhuhai (CN)

(73) Assignee: Gree Electric Appliances, Inc. of Zhuhai, Zhuhai (CN)

( * ) Notice: Subject to any disclaimer, the term of this patent is extended or adjusted under 35 U.S.C. 154(b) by 420 days.

(21) Appl. No.: 14/239,219

(22) PCT Filed: Aug. 13, 2012

(86) PCT No.: PCT/CN2012/080050

§ 371 (c)(1),
(2), (4) Date: Feb. 17, 2014

(87) PCT Pub. No.: WO2013/023568

PCT Pub. Date: Feb. 21, 2013

(65) Prior Publication Data

US 2014/0194051 A1 Jul. 10, 2014

(30) Foreign Application Priority Data

Aug. 16, 2011 (CN) ..... 2011 1 0234136

(51) Int. Cl.

| | |
|---|---|
| ***F24F 7/00*** | (2006.01) |
| ***F24F 13/10*** | (2006.01) |
| ***F24F 7/04*** | (2006.01) |
| ***F24F 1/00*** | (2011.01) |
| *F24F 13/14* | (2006.01) |

(52) U.S. Cl.

CPC ..... *F24F 7/04* (2013.01); *F24F 1/0011* (2013.01); *F24F 13/1406* (2013.01); *F24F 2013/1433* (2013.01); *F24F 2013/1446* (2013.01)

(58) Field of Classification Search

CPC ..... F24F 13/1406; F24F 1/0011; F24F 2013/1433; F24F 2013/1446; F24F 7/04

USPC ..... 454/333

See application file for complete search history.

(56) References Cited

U.S. PATENT DOCUMENTS 6,786,061 B2 * 9/2004 Asami ..... F24F 1/0011 165/122
D744,076 S * 11/2015 Xu ..... D23/351

(Continued)

FOREIGN PATENT DOCUMENTS

| | | |
|---|---|---|
| CA | 2845420 | 2/2013 |
| CN | 201155825 Y | 11/2008 |

(Continued)

*Primary Examiner* — Steven B McAllister
*Assistant Examiner* — Jonathan Cotov
(74) *Attorney, Agent, or Firm* — The Webb Law Firm

(57) ABSTRACT

An indoor unit of an air conditioner is provided, comprising an air duct, an air outlet in communication with the air duct, and an air deflector for guiding the direction of air outflow of the air conditioner, with a volute tongue being provided at an end of the air duct proximately to the air outlet, wherein the indoor unit of the air conditioner further comprises an air deflector opening and closing mechanism in drive connection with the air deflector which is rotatably provided at the outer side of the air outlet. The indoor unit of the air conditioner can sealingly close the air outlet with respect to the air deflector and avoid any gap from being formed between the air deflector and the air outlet when the air deflector is closed.

14 Claims, 7 Drawing Sheets

(56) References Cited

U.S. PATENT DOCUMENTS

| | | | | |
|---|---|---|---|---|
| 2009/0095106 | A1* | 4/2009 | Hollender | F24F 13/1426 74/425 |
| 2014/0194051 | A1* | 7/2014 | Shang | F24F 1/0011 454/333 |
| 2014/0199936 | A1* | 7/2014 | Shang | F24F 13/10 454/307 |
| 2014/0199937 | A1 | 7/2014 | Shang et al. | |

FOREIGN PATENT DOCUMENTS

| | | | |
|---|---|---|---|
| CN | 201246855 | Y | 5/2009 |
| CN | 202254159 | U | 5/2012 |
| CN | 202254164 | U | 5/2012 |
| CN | 202254165 | U | 5/2012 |
| EP | 2031320 | | 3/2009 |
| JP | 8247491 | A | 9/1996 |
| JP | 2002031400 | A | 1/2002 |
| JP | 2011012926 | A | 1/2011 |
| WO | 2011007520 | A1 | 1/2011 |
| WO | 2011016171 | A1 | 2/2011 |

* cited by examiner

INDOOR UNIT OF AIR CONDITIONER

TECHNICAL FIELD

The disclosure relates to an air conditioner, and in particular relates to an indoor unit of an air conditioner.

BACKGROUND

An indoor unit of an air conditioner known in the art is provided with an air deflector component for guiding upper and lower air outflow directions of the air conditioner. With such an existing air deflector, a driving motor is fixedly mounted to a base, and when the air deflector is rotating, the position of the rotational axis is stationary. In order to make room for the rotation of the deflector, usually a rotation space is provided around the air deflector and the air outlet, and gaps are formed between the air outlet and the air deflector while the air deflector is in a fully closed arrangement when the air conditioner is not in operation (gaps are formed at the left, right, upper and lower sides). This impairs the appearance aesthetics of the air conditioner. Moreover, the movement of the air deflector is simple, merely involving rotational movement about a stationary axis, and a variety of air supply angles cannot be obtained. Meanwhile, as the air outlet is not completely closed, dust, mildew and the like can be introduced into the interior of the indoor unit of the air conditioner and thus impair the cleanliness of indoor air.

SUMMARY

An object of the disclosure is to provide an indoor unit of an air conditioner, which can sealingly close the air outlet with respect to the air deflector and avoid any gap from being formed between the air deflector and the air outlet when the air deflector is closed.

Some embodiments are illustrated as follows.

According to one aspect of the disclosure, an indoor unit of an air conditioner is provided, comprising an air duct, an air outlet in communication with the air duct, and an air deflector for guiding the direction of air outflow of the air conditioner, with a volute tongue being provided at an end of the air duct proximately to the air outlet, wherein the indoor unit of the air conditioner further comprises an air deflector opening and closing mechanism in drive connection with the air deflector which is rotatably provided at the outer side of the air outlet.

In a further embodiment, the air deflector opening and closing mechanism can comprise a left push-out device located at a left support end of the air deflector and a right push-out device located at a right support end of the air deflector, and the left push-out device and the right push-out device can have a first end fixed to the housing of the air conditioner and a second end in drive connection with the air deflector, respectively.

In a further embodiment, the left push-out device can comprise a first pushing motor, a left gear in drive connection with the first pushing motor, and a left rack connecting rod in engagement with the left gear and in drive connection with the air deflector.

In a further embodiment, the left push-out device can further comprise a left case, wherein the first pushing motor can be fixedly provided at the outside of the left case, with an output shaft of the first pushing motor extending through a side wall of the left case and being in drive connection with the left gear located in an inner chamber of the left case, and wherein the left rack connecting rod can have an inner end movably located in the inner chamber of the left case and an outer end extending out of the left case and being in drive connection with the left support end of the air deflector.

In a further embodiment, the left push-out device can further comprise a rotation driving motor fixedly connected with the left rack connecting rod, and an output shaft of the rotation driving motor can be fixedly connected with the left support end of the air deflector.

In a further embodiment, the rotation driving motor can be located at the second end of the left push-out device, wherein the left support end of the air deflector can be configured with a rib located at the left side of the back of the air deflector, the rib being provided with a motor mounting hole engaged with the output shaft of the rotation driving motor which extends through the motor mounting hole of the rib. In a further embodiment, the right push-out device can comprise a second pushing motor, a right gear in drive connection with the second pushing motor, and a right rack connecting rod in engagement with the right gear.

In a further embodiment, the right push-out device can further comprise a right case, wherein the second pushing motor can be fixedly provided at the outside of the right case, with an output shaft of the second pushing motor extending through a side wall of the right case and being in drive connection with the right gear located in an inner chamber of the right case, and wherein the right rack connecting rod can have an inner end movably located in the inner chamber of the right case and an outer end extending out of the right case and being in drive connection with the right support end of the air deflector.

In a further embodiment, the left rack connecting rod or the right rack connecting rod can have a rectilinear or curved configuration; wherein the left case can comprise a snap-fitted left upper fixing case and left lower fixing case; wherein the left case can have a first end fixed to the housing of the air conditioner and a second end formed with an opening through which the outer end of the left rack connecting rod extends; wherein the right case can comprise a snap-fitted right upper fixing case and right lower fixing case; and wherein the right case can have a first end fixed to the housing of the air conditioner and a second end formed with an opening through which the outer end of the right rack connecting rod extends.

In a further embodiment, a right connecting end configured with a rib can be provided at the right end of the back of the air deflector, and a rack connecting rod mounting hole can be formed at the right connecting end; wherein a pin shaft can be provided at the outer end of the right rack connecting rod and be engaged with the rack connecting rod mounting hole; wherein the rack connecting rod mounting hole can have a notch complementary with the peripheral wall of the pin shaft; and wherein a mushroom-shaped protrusion can be provided at an end of the pin shaft for preventing the pin shaft from being disengaged.

In a further embodiment, a right connecting end configured with a rib can be fixedly provided at a side surface of the right support end of the air deflector facing the air outlet, and a rack connecting rod mounting hole can be formed at the right connecting end; wherein a pin shaft can be provided at the outer end of the right rack connecting rod and be engaged with the rack connecting rod mounting hole; wherein the rack connecting rod mounting hole can have a notch complementary with the peripheral wall of the pin shaft; and wherein a stopping protrusion can be provided at the end of the pin shaft for preventing the pin shaft from being disengaged.

In a further embodiment, the indoor unit of the air conditioner can further comprise a middle support mechanism, which can be telescopically provided between the air deflector and the volute tongue.

In a further embodiment, the middle support mechanism can be in the form of a multi-link linkage mechanism, which can comprise a seat fixedly connected to the volute tongue, a first link rod and a second link rod; wherein a seat sliding groove can be formed in an inner cavity of the seat, and an inner end of the first link rod can be provided movably along the seat sliding groove in the inner cavity of the seat; wherein a link rod sliding groove can be formed in an inner cavity of the first link rod, and an inner end of the second link rod can be provided movably along the link rod sliding groove in the inner cavity of the first link rod; and wherein an outer end of the second link rod can be hinged to a middle support rib provided at the side surface of the air deflector facing the air outlet.

In a further embodiment, the volume of the portions of the left push-out device and the right push-out device located below a horizontal midline of the air outlet can be greater than the volume of the portions thereof located above the horizontal midline of the air outlet when the air deflector is in a closed state.

In a further embodiment, the left push-out device and the right push-out device can be fixed to the side walls of the housing of the air conditioner.

The following advantages can be achieved by the disclosure.

The indoor unit of the air conditioner of the disclosure is provided with an air deflector opening and closing mechanism and the air deflector rotatably provided at the outer side of the air outlet, and thus during rotation of the air deflector, the rotation space is entirely located at the outer side of the air outlet; and when the air conditioner is not in operation, the air deflector covers the outer end of the air outlet, and the area that the air deflector covers is greater than or equal to the area of the outer end of the air outlet. When the air deflector is closed, it is closely fitted to the panel body without any gap formed therebetween.

When the air deflector is opened, it is pushed out by the left and right push-out devices, and at the same time the rotation driving motor operates to drive the air deflector to rotate; the displacement of the air deflector can be controlled by controlling the motors of the left and right push-out devices; and the rotation angle of the air deflector can be controlled by controlling the rotation driving motor. A middle support mechanism is fixed to the housing of the air conditioner, and is not driven by power, which has supporting and guiding functions and prevents any deformation or swing of the air deflector during movement.

The indoor unit of the air conditioner of the disclosure can be assembled in a simple way, which can sealingly close the air outlet with respect to the air deflector and avoid any gap from being formed between the air deflector and the air outlet when the air deflector is closed. Furthermore, the air deflector can have various rotating angles and more complicated movement, and can perform various modes of air supply in a comfortable way as required by users, which is advantageous and competitive in the market.

LIST OF REFERENCE NUMERALS

1 air deflector, 2 middle support mechanism, 3 left push-out device, 4 volute tongue, 5 right push-out device, 11 middle support rib, 21 second link rod, 22 first link rod, 31 rotation driving motor, 32 first pushing motor, 33 left upper fixing case, 34 left lower fixing case, 35 left gear, 36 left rack connecting rod, 51 second pushing motor, 52 right rack connecting rod, 53 right upper fixing case, 54 right lower fixing case, 55 right gear, 521 pin shaft.

DETAILED DESCRIPTION

Figure 1:
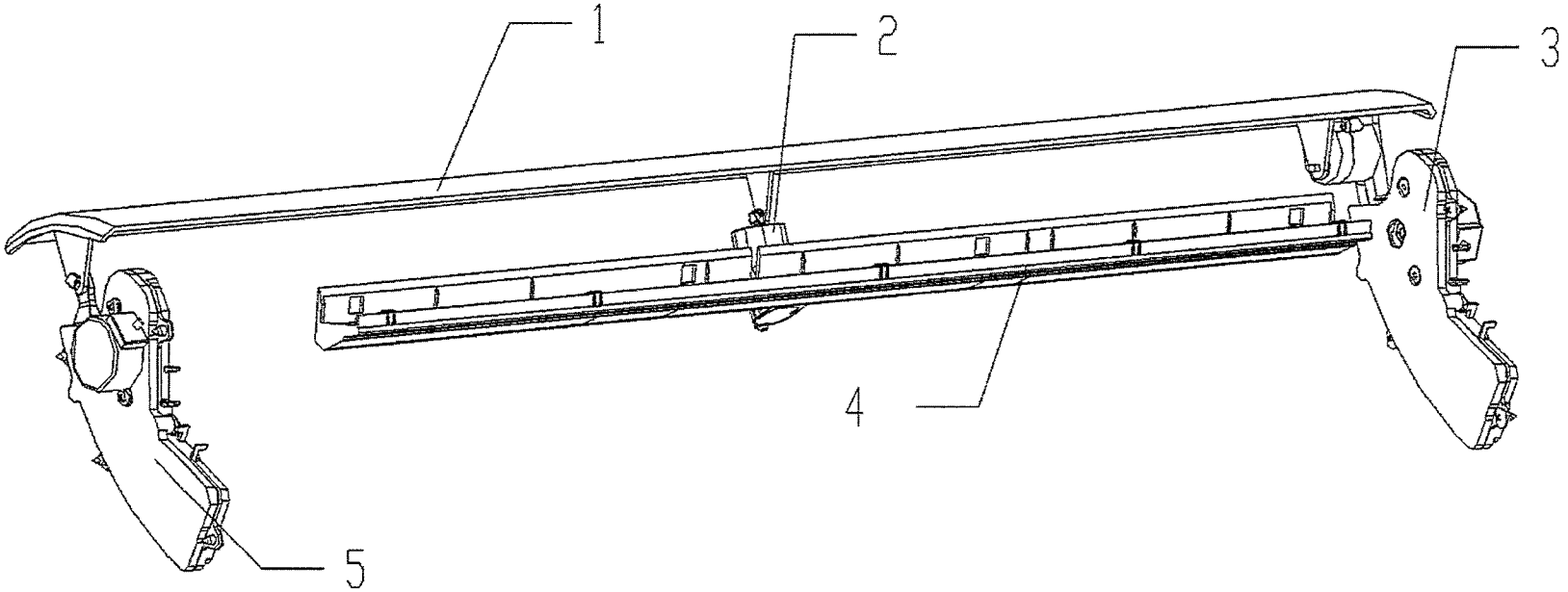
FIG. 1 is a schematic view of an air deflector and an air deflector opening and closing mechanism of an indoor unit of an air conditioner of the disclosure in an overall assembled arrangement.
Figure 2:
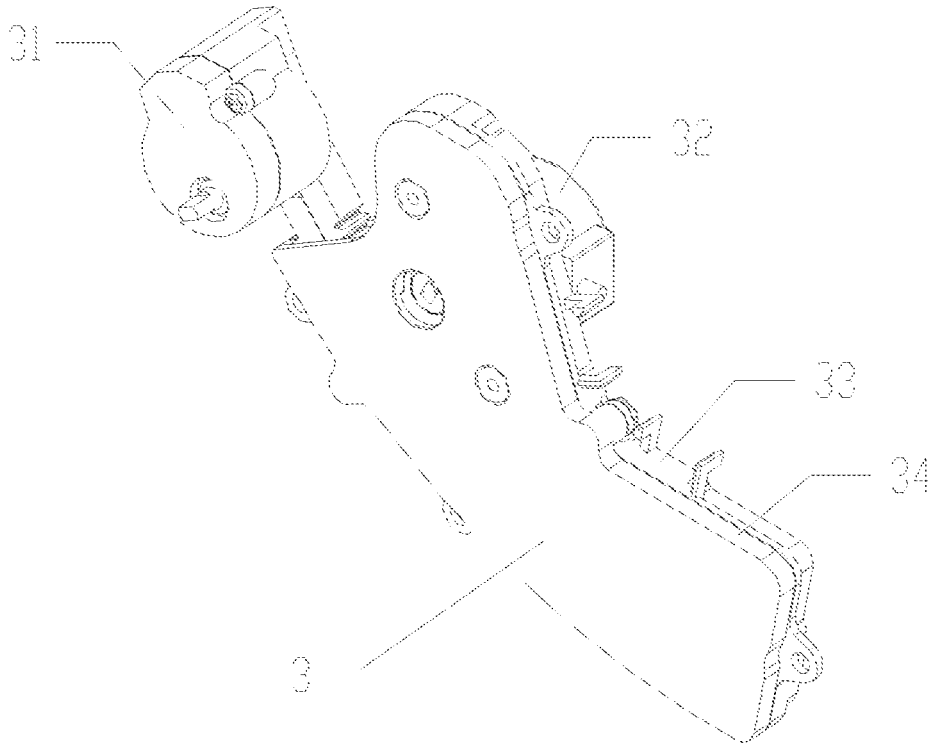
FIG. 2 is a schematic view of a left push-out device of the indoor unit of the air conditioner of the disclosure, showing the overall arrangement of the left push-out device.
Figure 3:
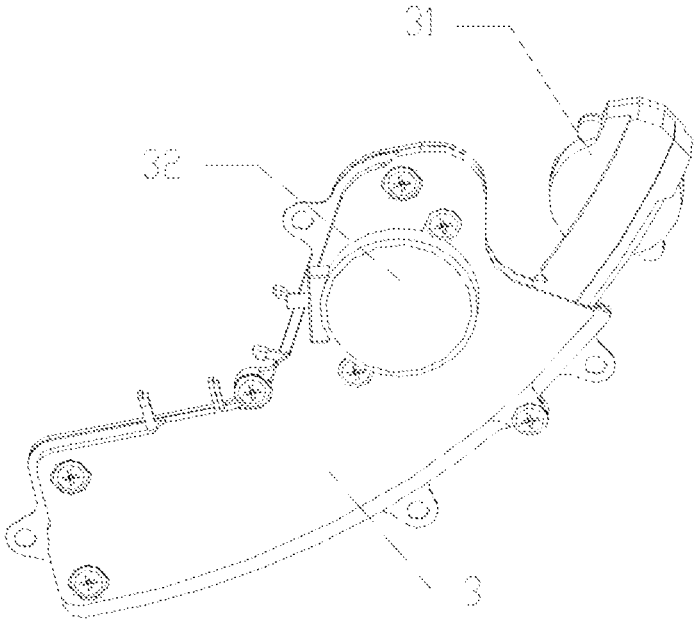
FIG. 3 is a schematic view of a rotation driving motor of the indoor unit of the air conditioner of the disclosure, showing the position of the rotation driving motor.
Figure 4:
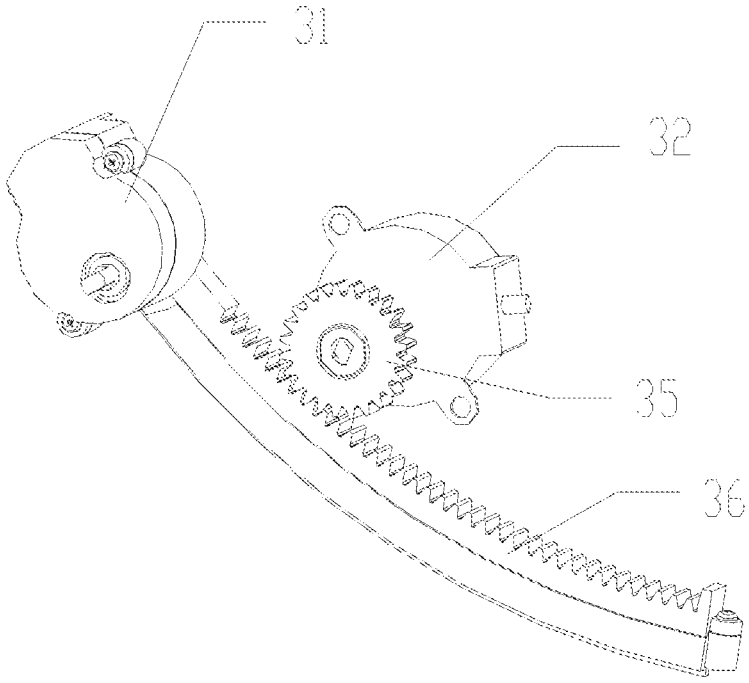
FIG. 4 is a schematic view of a left push-out device of the indoor unit of the air conditioner of the disclosure, showing the internal arrangement of the left push-out device.
Figure 5:
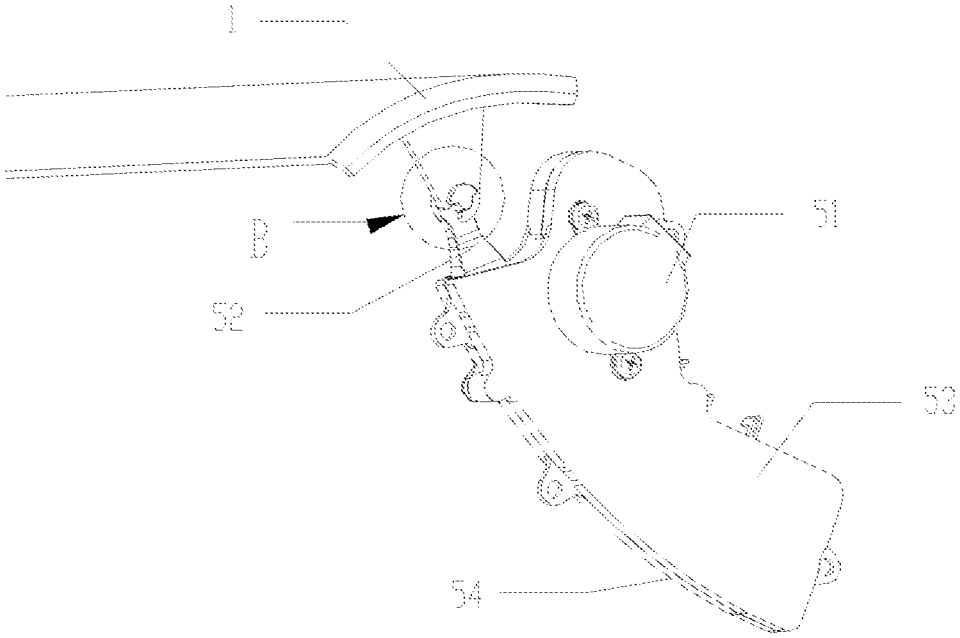
FIG. 5 is a schematic view of a right push-out device of the indoor unit of the air conditioner of the disclosure, showing the overall arrangement of the right push-out device.
Figure 6:
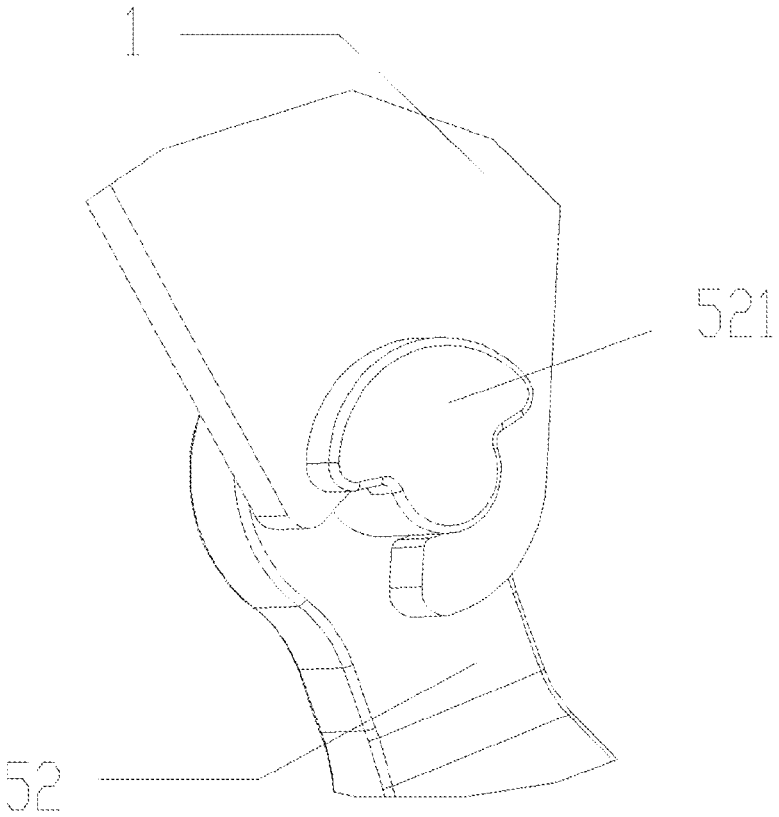
FIG. 6 is a partial enlarged schematic view of a connecting arrangement for connecting the right push-out device and the air deflector of the indoor unit of the air conditioner of the disclosure.
Figure 7:
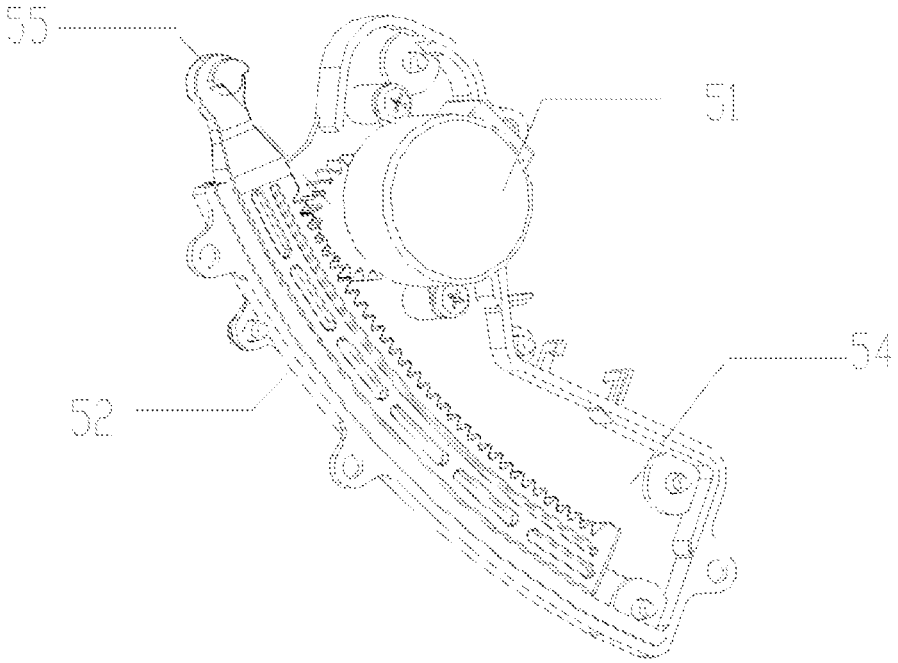
FIG. 7 is a schematic view of a right push-out device of the indoor unit of the air conditioner of the disclosure, showing the internal arrangement of the right push-out device.
Figure 8:
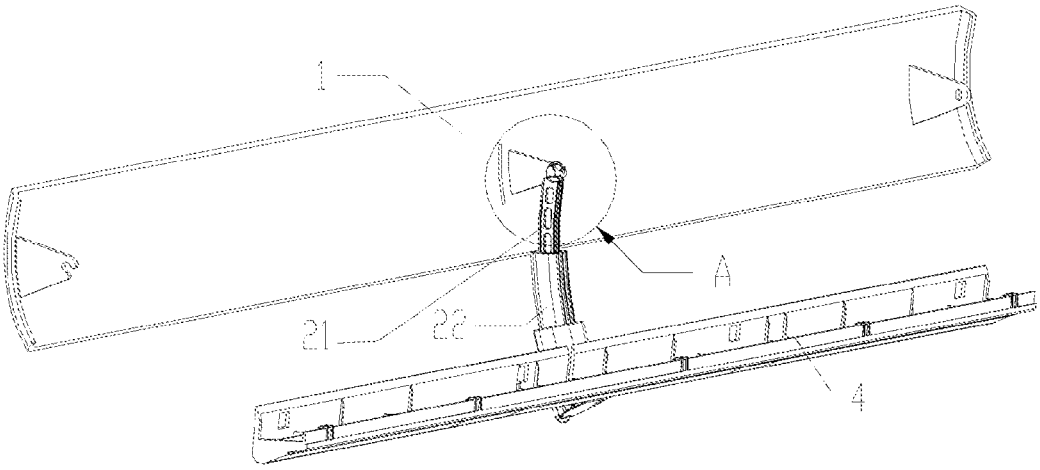
FIG. 8 is a schematic view of a middle support mechanism of the indoor unit of the air conditioner of the disclosure, showing the overall arrangement of the middle support mechanism in an extended state.
Figure 9:
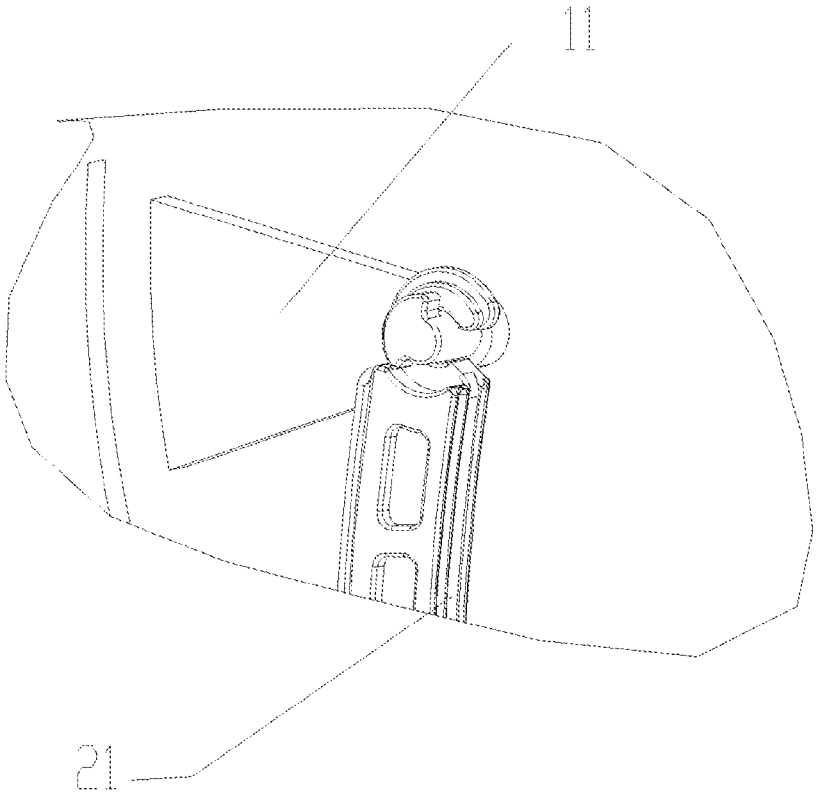
FIG. 9 is a partial enlarged schematic view of a connecting arrangement for connecting the middle support mechanism and the air deflector of the indoor unit of the air conditioner of the disclosure.
Figure 10:
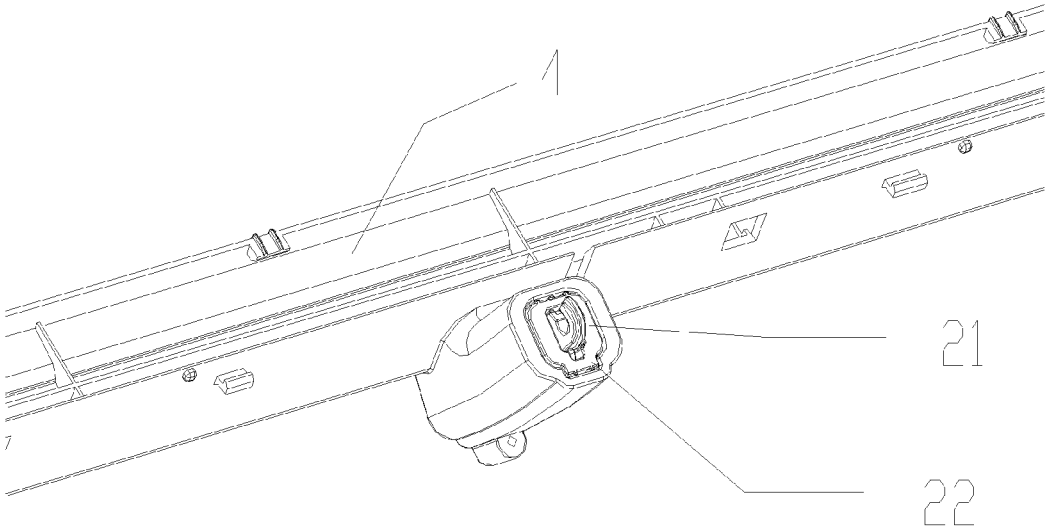
FIG. 10 is a schematic view of a middle support mechanism of the indoor unit of the air conditioner of the disclosure, showing the overall arrangement of the middle support mechanism in a retracted state.
Figure 11A:
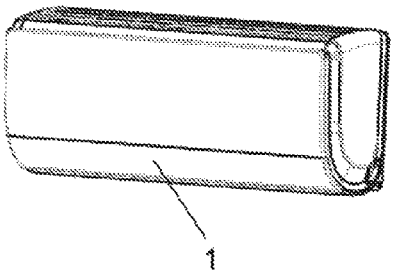
FIG. 11A is a schematic view of an indoor unit of an air conditioner including an air deflector in a closed position covering an outer end of an air outlet.
Figure 11B:
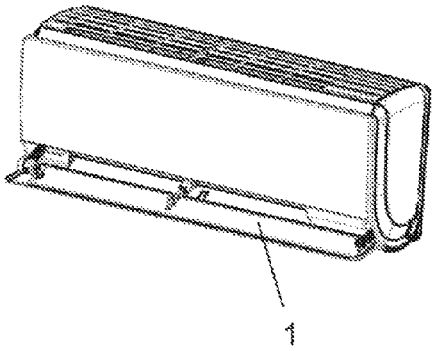
FIG. 11B is a schematic view of an indoor unit of an air conditioner including an air deflector in an open position.

The disclosure provides an indoor unit of an air conditioner, as shown in FIG. 1, which comprises an air duct, an air outlet in communication with the air duct, and an air deflector 1 for guiding the direction of air outflow of the air conditioner, with a volute tongue 4 being provided at the outer end of the air duct proximately to the air outlet. In addition, the indoor unit of the air conditioner further comprises an air deflector opening and closing mechanism, which is in drive connection with the air deflector 1. When the air conditioner is in operation, the air deflector opening and closing mechanism can force the rotational axis of the air deflector 1 outwards away from the region of the air outlet, and thus the air deflector 1 is rotatably provided at the outside of the air outlet. During rotation of the air deflector 1, the rotation space for the air deflector is entirely located at the outside of the air outlet, and when the air conditioner is not in operation, the air deflector 1 covers the outer end of the air outlet.

The opening and closing mechanism for the air deflector 1 comprises a left push-out device 3 located at a left support end of the air deflector 1 and a right push-out device 5 located at a right support end of the air deflector 1. The left push-out device 3 and the right push-out device 5 have a first end fixed to the housing of the air conditioner and a second end in drive connection with the air deflector 1, respectively. The left push-out device 3 and the right push-out device 5 can move the air deflector 1 inward and outward. As shown in FIGS. 1, 2, 3 and 4, the left push-out device 3 comprises a first pushing motor 32, a left gear 35 in drive connection with the first pushing motor 32, a left rack connecting rod 36 in engagement with the left gear 35, and a left case. The left gear 35 is fixed to an output shaft of the first pushing motor 32, the first pushing motor 32 is fixed at the outside of the left case, the left gear 35 is located in an inner chamber of the left case, and an output shaft of the first pushing motor 32 extends through a side wall of the left case and is in drive connection with the left gear 35. The inner end of the left rack connecting rod 36 is located in the inner chamber of the left case and is capable of making reciprocating movement, and the outer end of the left rack connecting rod 36 extends out of the left case and is in drive connection with the left support end of the air deflector 1. The left push-out device 3 further comprises a rotation driving motor 31, which is fixedly connected with the left rack connecting rod 36, and an output shaft of the rotation driving motor 31 is directly fixed to the left support end of the air deflector 1.

The rotation driving motor 31 is located at the second end of the left push-out device 3. The left support end of the air deflector 1 is configured with a rib located at the left side of the back of the air deflector 1, i.e. the rear side of the air deflector 1 facing the air outlet. The rib has a motor mounting hole which can be engaged with the output shaft of the rotation driving motor 31, and the output shaft of the rotation driving motor 31 can be directly inserted into the motor mounting hole of the rib.

As shown in FIGS. 1, 5, 6 and 7, the right push-out device 5 comprises a second pushing motor 51, a right gear 55 in drive connection with the second pushing motor 51, a right rack connecting rod 52 in engagement with the right gear 55, and a right case. The right gear 55 is fixed to an output shaft of the second pushing motor 51. The second pushing motor 51 is fixed at the outside of the right case, the right gear 55 is located in an inner chamber of the right case, and the output shaft of the second pushing motor 51 extends through a side wall of the right case and is in drive connection with the right gear 55. The inner end of the right rack connecting rod 52 is located in the inner chamber of the right case and is capable of making reciprocating movement, and the outer end of the right rack connecting rod 52 extends out of the right case and is in drive connection with the right support end of the air deflector 1.

The left rack connecting rod 36 or the right rack connecting rod 52 has a rectilinear or curved configuration. The left case comprises a snap-fitted left upper fixing case 33 and left lower fixing case 34. An opening is formed at the second end of the left case for the left rack connecting rod 36 to extend through. The first end of the left case is fixed to the housing of the air conditioner. The right case comprises a snap-fitted right upper fixing case 53 and right lower fixing case 54. An opening is formed at the second end of the right case for the right rack connecting rod 52 to extend through. The first end of the right case is fixed to the housing of the air conditioner.

A right connecting end is provided at the right end of the back of the air deflector 1, and the right connecting end can have a rib configuration. A rack connecting rod mounting hole is formed at the right connecting end. A pin shaft 521 is provided at the outer end of the right rack connecting rod 52 and is engaged with the rack connecting rod mounting hole. The rack connecting rod mounting hole has a notch corresponding to the peripheral wall of the pin shaft 521 to facilitate entrance and exit of the pin shaft 521. An end of the pin shaft 521 is provided with a mushroom-shaped protrusion for preventing the pin shaft 521 from being disengaged, or is provided with a stopping protrusion for preventing the pin shaft 521 from being disengaged.

In order that the indoor unit of the air conditioner has a more compact internal arrangement and a higher efficiency of space utilization, the volume of the portions of the left push-out device 3 and the right push-out device 5 located below a horizontal midline of the air outlet is greater than the volume of the portions thereof located above the horizontal midline of the air outlet when the air deflector 1 is in a closed state. The left push-out device 3 and the right push-out device 5 are fixed to the housing of the air conditioner at the side walls of the housing of the air conditioner.

As shown in FIGS. 1, 8, 9 and 10, the indoor unit of the air conditioner further comprises a middle support mechanism 2, which is telescopically provided between the air deflector 1 and the volute tongue 4. The length of the middle support mechanism 2 can vary as a function of the position of the moving air deflector 1. One end of the middle support mechanism 2 is fixed within the housing of the air conditioner, and the other end thereof is connected to the middle of the back of the air deflector 1.

The middle support mechanism 2 may be configured as a multi-link linkage mechanism, which herein refers to a connecting arrangement comprising a plurality of connecting rods being movable with respect to one another and a base for mounting the connecting rods. Specifically, in a particular embodiment, the multi-link linkage mechanism comprises a seat fixedly connected to the middle of the volute tongue 4, a first link rod 22 and a second link rod 21. A seat sliding groove is formed in an inner cavity of the seat, and an inner end of the first link rod 22 is located in the inner cavity of the seat and is capable of making reciprocating movement along the seat sliding groove. A link rod sliding groove is formed in an inner cavity of the first link rod 22, and an inner end of the second link rod 21 is located in the inner cavity of the first link rod 22 and makes reciprocating movement along the link rod sliding groove. An outer end of the second link rod 21 is hinged to a middle support rib 11 positioned in the middle of the back of the air deflector 1.

In order to provide an indoor unit of an air conditioner for avoiding any gap from being formed between the air deflector and the air outlet at the left, right, upper and lower sides, the rotational axis of the air deflector is moved away from the air outlet when the air deflector rotates, in such a way that during the rotation of the air deflector, the rotation space is entirely located at the outer side of the air outlet and is offset from the air outlet so that the rotating air deflector will not pass the air outlet. According to the disclosure, an air deflector opening and closing mechanism is located at the left and right sides of the panel, which has motors for driving gears to rotate, and the gears in turn drive the rack connecting rods to move. The arrangement of the rack connecting rod at the left side is different from that at the right side in that a motor can be further installed on one of the rack connecting rods. A support mechanism is further provided in the middle of the volute tongue, and the support mechanism can be extended and retracted by means of the connecting rods with multiple links and has supporting and guiding functions to prevent deformation of the air deflector during operation.

It is noted that, the forgoing description is intended to illustrate and not limit the claimed scope, and various modifications and alterations can be made by those skilled in the art without departing from the claimed scope and will fall into the claimed protection scope.

The invention claimed is:

1. An indoor unit of an air conditioner, comprising:

an air duct, an air outlet in communication with the air duct, an air deflector for guiding the direction of air outflow of the air conditioner, a volute tongue at an end of the air duct proximate the air outlet, a middle support mechanism telescopically connecting the air deflector and the volute tongue, and an air deflector opening and closing mechanism in drive connection with the air deflector which is rotatably provided at the outer side of the air outlet, wherein when the air conditioner is not in operation, the air deflector covers the outer end of the air outlet, and an area that the air deflector covers is greater than or equal to an area of the outer end of the air outlet and whereby the air outlet is sealingly closed and no gap is formed between the air deflector and the air outlet when the air deflector is closed.

2. The indoor unit of the air conditioner of claim 1, wherein the air deflector opening and closing mechanism comprises a left push-out device located at a left support end of the air deflector and a right push-out device located at a right support end of the air deflector, and the left push-out device and the right push-out device have a first end fixed to a housing of the air conditioner and a second end in drive connection with the air deflector, respectively.

3. The indoor unit of the air conditioner of claim 1, wherein the middle support mechanism is in the form of a multi-link linkage mechanism, which comprises a seat fixedly connected to the volute tongue, a first link rod and a second link rod; wherein a seat sliding groove is formed in an inner cavity of the seat, and an inner end of the first link rod is provided movably along the seat sliding groove in the inner cavity of the seat; wherein a link rod sliding groove is formed in an inner cavity of the first link rod, and an inner end of the second link rod is provided movably along the link rod sliding groove in the inner cavity of the first link rod; and wherein an outer end of the second link rod is hinged to a middle support rib provided at the side surface of the air deflector facing the air outlet.

4. The indoor unit of the air conditioner of claim 2, wherein the left push-out device comprises a first pushing motor, a left gear in drive connection with the first pushing motor, and a left rack connecting rod in engagement with the left gear and in drive connection with the air deflector.

5. The indoor unit of the air conditioner of claim 2, wherein the volume of the portions of the left push-out device and the right push-out device located below a horizontal midline of the air outlet is greater than the volume of the portions thereof located above the horizontal midline of the air outlet when the air deflector is in a closed state.

6. The indoor unit of the air conditioner of claim 2, wherein the left push-out device and the right push-out device are fixed to the side walls of the housing of the air conditioner.

7. The indoor unit of the air conditioner of claim 4, wherein the left push-out device further comprises a left case, wherein the first pushing motor is fixedly provided at the outside of the left case, with an output shaft of the first pushing motor extending through a side wall of the left case and being in drive connection with the left gear located in an inner chamber of the left case, and wherein the left rack connecting rod has an inner end movably located in the inner chamber of the left case and an outer end extending out of the left case and being in drive connection with the left support end of the air deflector.

8. The indoor unit of the air conditioner of claim 4, wherein the left push-out device further comprises a rotation driving motor fixedly connected with the left rack connecting rod, and an output shaft of the rotation driving motor is fixedly connected with the left support end of the air deflector.

9. The indoor unit of the air conditioner of claim 8, wherein the rotation driving motor is located at the second end of the left push-out device, wherein the left support end of the air deflector is configured with a rib located at the left side of a back of the air deflector, the rib being provided with a motor mounting hole engaged with the output shaft of the rotation driving motor which extends through the motor mounting hole of the rib.

10. The indoor unit of the air conditioner of claim 7, wherein the right push-out device comprises a second pushing motor, a right gear in drive connection with the second pushing motor, and a right rack connecting rod in engagement with the right gear.

11. The indoor unit of the air conditioner of claim 10, wherein the right push-out device further comprises a right case, wherein the second pushing motor is fixedly provided at the outside of the right case, with an output shaft of the second pushing motor extending through a side wall of the right case and being in drive connection with the right gear located in an inner chamber of the right case, and wherein the right rack connecting rod has an inner end movably located in the inner chamber of the right case and an outer end extending out of the right case and being in drive connection with the right support end of the air deflector.

12. The indoor unit of the air conditioner of claim 11, wherein the left rack connecting rod or the right rack connecting rod has a rectilinear or curved configuration; wherein the left case comprises a snap-fitted left upper fixing case and left lower fixing case; wherein the left case has a first end fixed to the housing of the air conditioner and a second end formed with an opening through which the outer end of the left rack connecting rod extends; wherein the right case comprises a snap-fitted right upper fixing case and right lower fixing case; and wherein the right case has a first end fixed to the housing of the air conditioner and a second end formed with an opening through which the outer end of the right rack connecting rod extends.

13. The indoor unit of the air conditioner of claim 12, wherein a right connecting end configured with a rib is provided at the right end of a back of the air deflector, and a rack connecting rod mounting hole is formed at the right connecting end; wherein a pin shaft is provided at the outer end of the right rack connecting rod and is engaged with the rack connecting rod mounting hole; wherein the rack connecting rod mounting hole has a notch complementary with a peripheral wall of the pin shaft; and wherein a mushroom-shaped protrusion is provided at an end of the pin shaft for preventing the pin shaft from being disengaged.

14. The indoor unit of the air conditioner of claim 12, wherein a right connecting end configured with a rib is fixedly provided at a side surface of the right support end of the air deflector facing the air outlet, and a rack connecting rod mounting hole is formed at the right connecting end; wherein a pin shaft is provided at the outer end of the right rack connecting rod and is engaged with the rack connecting rod mounting hole; wherein the rack connecting rod mounting hole has a notch complementary with a peripheral wall of the pin shaft; and wherein a stopping protrusion is provided at the end of the pin shaft for preventing the pin shaft from being disengaged.

* * * * *